US006033080A

United States Patent [19]

Hasegawa et al.

[11] Patent Number: 6,033,080

[45] Date of Patent: Mar. 7, 2000

[54] EMERGENCY LIGHT OPERABLE ON THE LEVER PRINCIPLE

[75] Inventors: Kouichi Hasegawa; Masahito Maeda; Satoshi Demachi, all of Tokyo, Japan

[73] Assignee: Nohmi Bosai Ltd., Tokyo, Japan

[21] Appl. No.: 09/028,690

[22] Filed: Feb. 24, 1998

[30] Foreign Application Priority Data

Feb. 25, 1997 [JP] Japan ..... 9-041056

[51] Int. Cl.[7] ..... F21K 2/00

[52] U.S. Cl. ..... 362/34; 362/84; 362/190; 362/191

[58] Field of Search ..... 362/34, 84, 190, 362/191

[56] References Cited

U.S. PATENT DOCUMENTS

| | | | |
|---|---|---|---|
| 3,900,728 | 8/1975 | Holcombe | 240/52 |
| 4,193,109 | 3/1980 | Hefferman et al. | 362/34 |
| 4,379,320 | 4/1983 | Mohan et al. | 362/34 |
| 4,405,973 | 9/1983 | Moscarillo | 362/34 |
| 4,771,724 | 9/1988 | Baretz et al. . | |
| 5,446,629 | 8/1995 | Steiger et al. . | |

FOREIGN PATENT DOCUMENTS 2 412 029 7/1979 France .

*Primary Examiner*—Sandra O'Shea
*Assistant Examiner*—John Anthony Ward
*Attorney, Agent, or Firm*—Weneroth, Lind & Ponack, L.L.P.

[57] ABSTRACT

An emergency light includes a chemiluminescent light stick which can be easily operated to illuminate and taken out. When an operating lever is pushed, an engaging portion of a pivoting member pushes the bottom portion of the chemiluminescent light stick toward a wall surface. The chemiluminescent light stick has on the top end thereof a head secured to a holding hook of a holding member. The chemiluminescent light stick can be easily bent to illuminate by the lever principle with the protuberance of a case body serving as a fulcrum and the engaging portion serving as the point of action. When the operating lever is further pushed, the top end of the pivoting member protrudes frontward to open a top cover, and at the same time, the holding member which has been restricted by the pivoting member is released and it moves upward by the urging force of a flat spring and the pressing force applied by the head of the chemiluminescent light stick, thus enabling the chemiluminescent light stick to be removed.

7 Claims, 8 Drawing Sheets

EMERGENCY LIGHT OPERABLE ON THE LEVER PRINCIPLE

BACKGROUND OF THE INVENTION

1. Field of the Invention

The present invention relates to an emergency light and, more particularly, to an emergency light which incorporates chemiluminescent light sticks to obviate the need for a power supply.

2. Description of Related Art

This type of emergency light requiring no power supply is disclosed in U.S. Pat. No. 5,446,629. As shown in FIG. 10, in this emergency light, with a case body 1 mounted on a wall surface 2 or the like, pulling the top of a cover 3 frontward away from the wall surface causes the cover 3 to pivot on the bottom end thereof. At this time, the upper half of a chemiluminescent light stick 5 housed inside by a hook 4 formed on the inner side of the cover 3 is broken frontward, causing the chemiluminescent light stick 5 to illuminate. The chemiluminescent light stick 5 has a double structure wherein a glass ampule filled with a second reaction liquid is housed in a stick which is made of a soft plastic material and which is filled with a first reaction liquid. When the chemiluminescent light stick 5 is bent as indicated by the dashed lines, the ampule is broken so that the first reaction liquid and the second reaction liquid mix with each other and react, thereby emitting light.

The emergency light mentioned above employs no power supply such as a battery; the moment the cover 3 is manually opened in case of an emergency such as a power failure, the chemiluminescent light stick 5 illuminates, so that it may be used as emergency lighting or the chemiluminescent light stick 5 may be taken out and used for evacuation.

There has been a disadvantage, however, in that a great force is required to pull the cover 3 frontward to break the chemiluminescent light stick 5 with the upper half of the chemiluminescent light stick 5 standing upright between the case body 1 and the cover 3 as illustrated in FIG. 10. Hence, it has been necessary to firmly mount the case body 1 on a sturdy wall surface 2. Further, to take out the chemiluminescent light stick 5, it has been required that the chemiluminescent light stick 5 be bent as illustrated by the dashed lines in FIG. 10 to illuminate, then the cover 3 be further opened frontward until the top of the chemiluminescent light stick 5 becomes free of the hook 4 of the cover 3.

SUMMARY OF THE INVENTION

The present invention has been made with a view toward solving the problems mentioned above, and it is an object of the present invention to provide an emergency light which causes chemiluminescent light sticks to illuminate and to be easily taken out even with a small force.

To this end, an emergency light according to a first aspect of the present invention comprises: a case body which is to be mounted on a wall surface or the like and which has a protuberance at the central portion thereof; a pivoting member pivotably mounted on the case body to move toward or away from the wall surface, the pivoting member having a retaining portion formed at a level lower than the pivoting center of the pivoting member and having an operating lever formed by the bottom end portion thereof extending downward from the case body; at least one chemiluminescent light stick which is disposed upright in the case body, the rear surface of the central portion of the stick being in contact with the protuberance of the case body, the front surface of the bottom of the stick being in contact with the retaining portion of the pivoting member; and a holding member for securing the top end portion of the chemiluminescent light stick to the case body, the bottom end portion of the chemiluminescent light stick contacted to the retaining portion of the pivoting member being pushed by pushing the operating lever toward the wall surface so that the chemiluminescent light stick is bent at the central portion thereof contacted to the protuberance of the case body to be illuminated.

The holding member may be engaged with the top end of the pivoting member and mounted on the case body so as to vertically pivot by the pivoting motion of the pivoting member, the holding member pivoting upward to release the top end portion of the chemiluminescent light stick when the operating lever is further pushed toward the wall surface after the chemiluminescent light stick illuminates.

A top cover may be mounted pivotably around the bottom end portion of the case body to open or close for covering the front portion of the case body, the top cover being pushed to be open by the top end portion of the pivoting member when the operating lever is pushed toward the wall surface.

An emergency light according to a second aspect of the present invention comprises: a case body to be mounted to a wall surface or the like; at least one chemiluminescent light stick held in the case body; a pressing jig which is rotatably provided in the vicinity of the central portion of the chemiluminescent light stick and which pushes the chemiluminescent light stick to bend it according to the rotational angle thereof; and a handle connected to the pressing jig; the handle being turned to bend the chemiluminescent light stick through the pressing jig thereby to cause the chemiluminescent light stick to illuminate.

A top cover may be provided to cover the front portion of the case body such that it may be opened or closed, the pressing jig and the handle being retained on the top cover.

DESCRIPTION OF THE PREFERRED EMBODIMENTS

Embodiments of the present invention will now be explained in conjunction with the accompanying drawings.

Figure 1A:
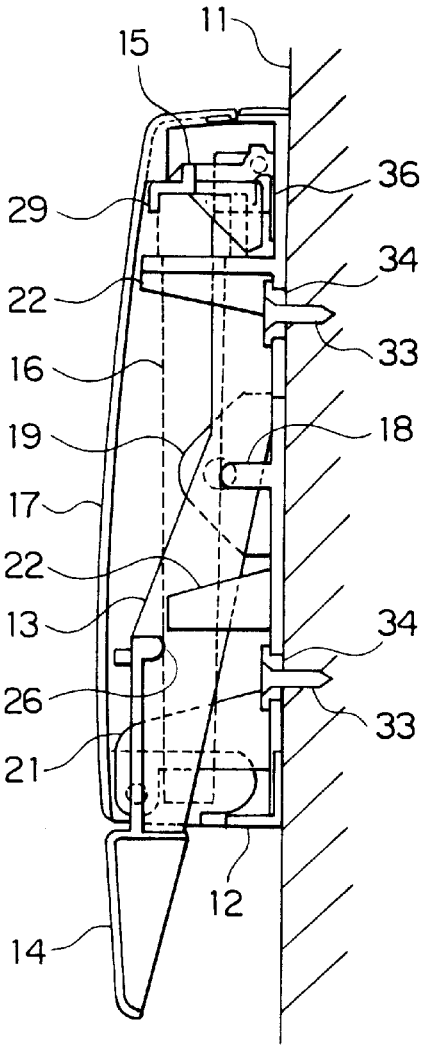
FIG. 1A is a side sectional view illustrating an emergency light in accordance with an embodiment of the present invention.
Figure 1B:
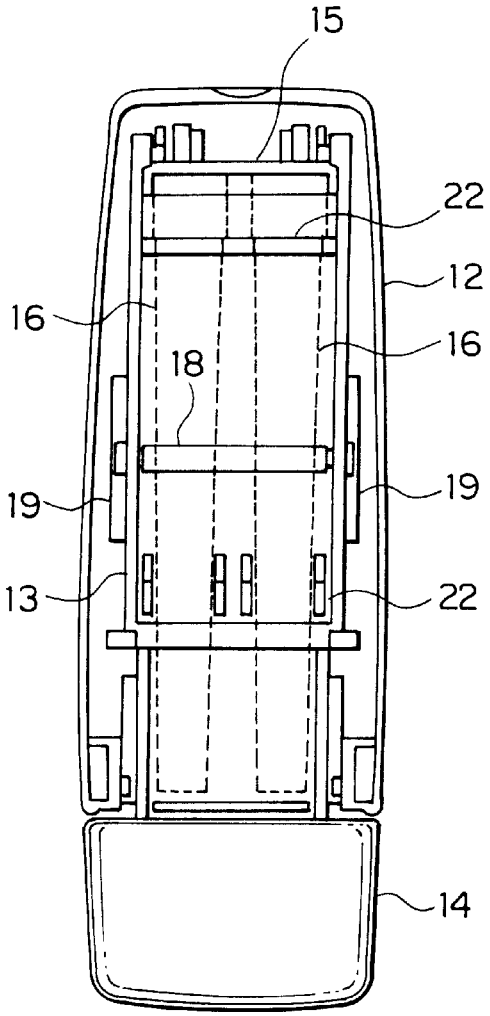
FIG. 1B is a front view of the emergency light with a top cover removed.

FIGS. 1A and 1B show an emergency light in accordance with an embodiment of the invention. The emergency light has a case body 12 attached to a wall surface 11, a pivoting member 13 being pivotably attached to the case body 12 to pivot toward or away from the wall surface 11. The bottom end portion of the pivoting member 13 extends downward from the case body 12 to form an operating lever 14. A holding member 15 is installed at the top portion of the case body 12 so that it may pivotably move up and down. Two chemiluminescent light sticks 16 are held upright side by side by the case body 12, the pivoting member 13 and the holding member 15. A top cover 17 for covering the front portion of the case body 12 is installed such that it may be opened or closed on the bottom end portion of the case body 12.

Figures 2A, 2B:
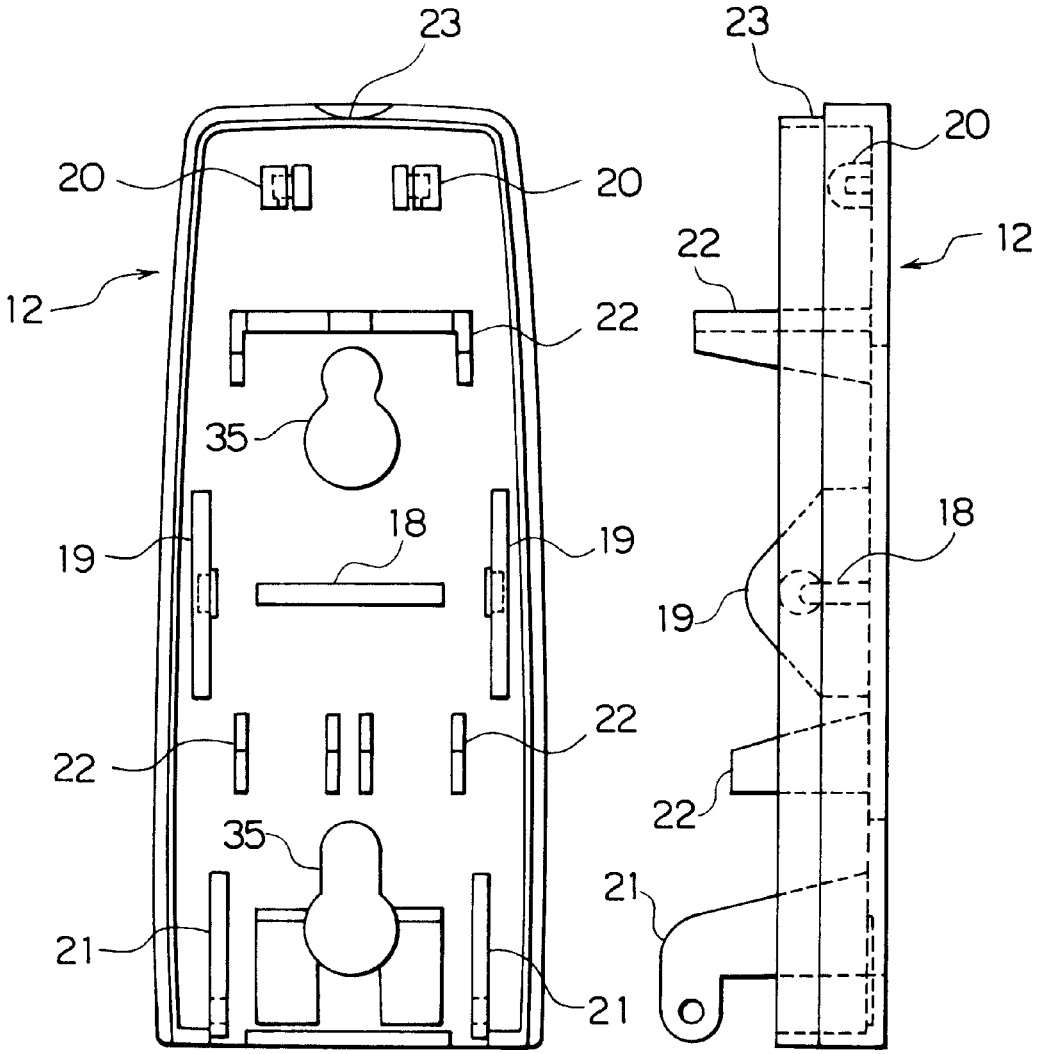
FIGS. 2A and 2B are a front view and a side view showing a case body used in such embodiment, respectively.

As illustrated in FIGS. 2A and 2B, the case body 12 has a protuberance 18 at the central portion thereof and pivoting member supports 19 formed on both sides of the protuberance 18. Holding member supports 20 are formed at the top portion of the case body 12 and top cover supports 21 are formed at the bottom portion of the case body 12. Further, chemiluminescent light stick retaining portions 22 are formed between the protuberance 18 and the holding member supports 20 and between the protuberance 18 and the top cover supports 21. A recessed portion 23 for retaining a corresponding portion of the top cover 17 is formed at the top end of the case body 12.

Figure 3A:
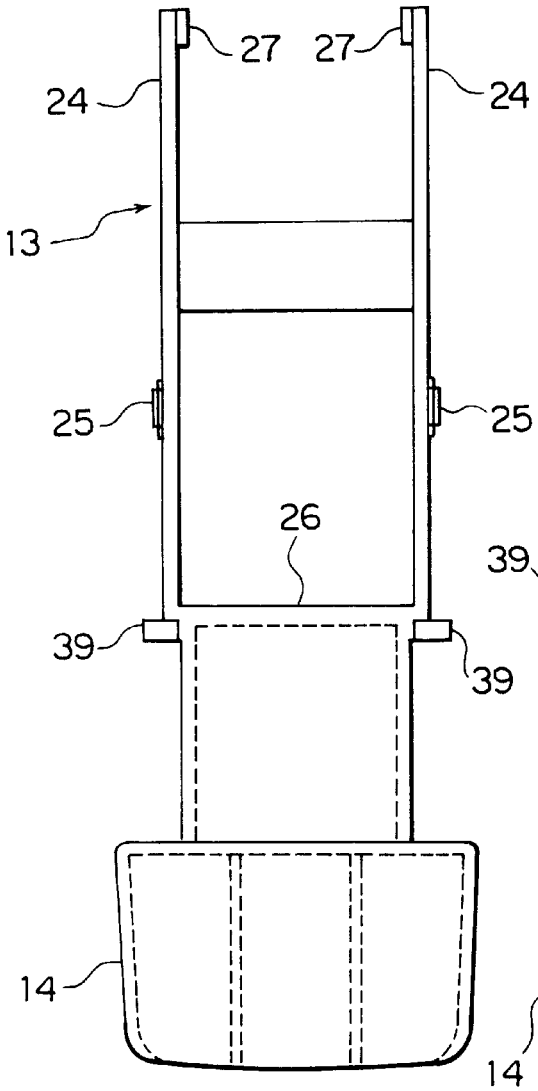
FIGS. 3A and 3B are a front view and a side view showing a pivoting member used in such embodiment, respectively.
Figure 3B:
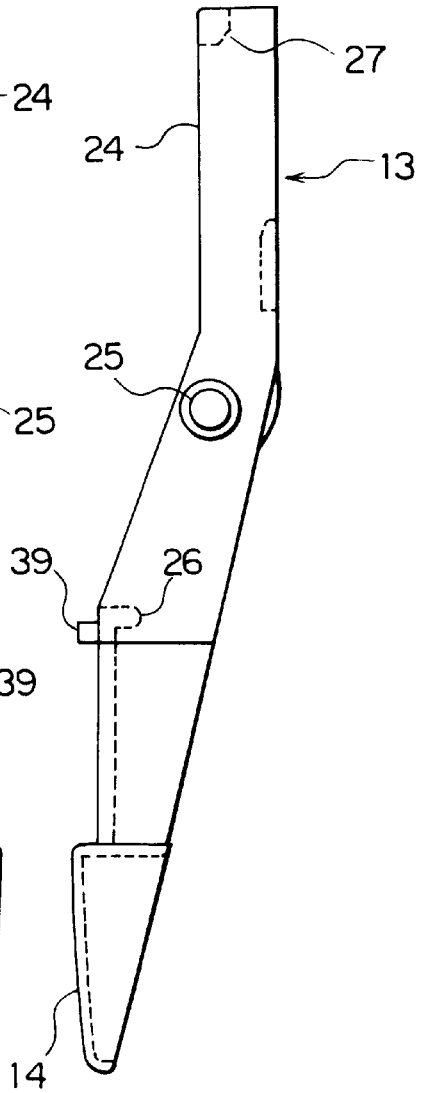

As illustrated in FIGS. 3A and 3B, the pivoting member 13 has a pair of arms 24 which extend upward in parallel to each other, and shafts 25 are formed at the central outer sides of the arms 24, the shafts 25 being fitted in support holes opened in the pivoting member supports 19 of the case body 12 to provide a pivoting center. Each of the arms 24 has a side surface contour shaped like an "L" slightly bent in the vicinity of the area where the shaft 25 is formed. At the root portions of the two arms 24, a protruded retaining portion 26 extends in the direction of the width of the pivoting member 13, and the operating lever 14 is formed underneath the retaining portion 26. Formed inside at the distal end of each arm 24 is an engaging protuberance 27 which engages with the holding member 15.

Figure 4A:
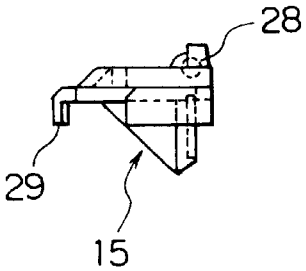
FIGS. 4A and 4B are a side view and a bottom view showing a holding member used in such embodiment, respectively.
Figure 4B:
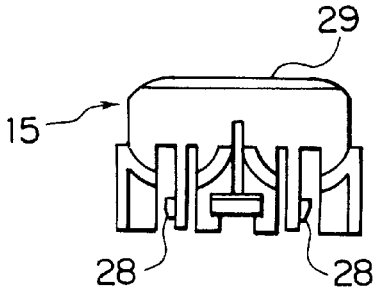

As shown in FIGS. 4A and 4B, the holding member 15 has shafts 28 to be fitted in the recessed portions formed on the holding member supports 20 of the case body 12 and also has a holding hook 29 which engages with the top ends of the chemiluminescent light sticks 16.

Figure 5A:
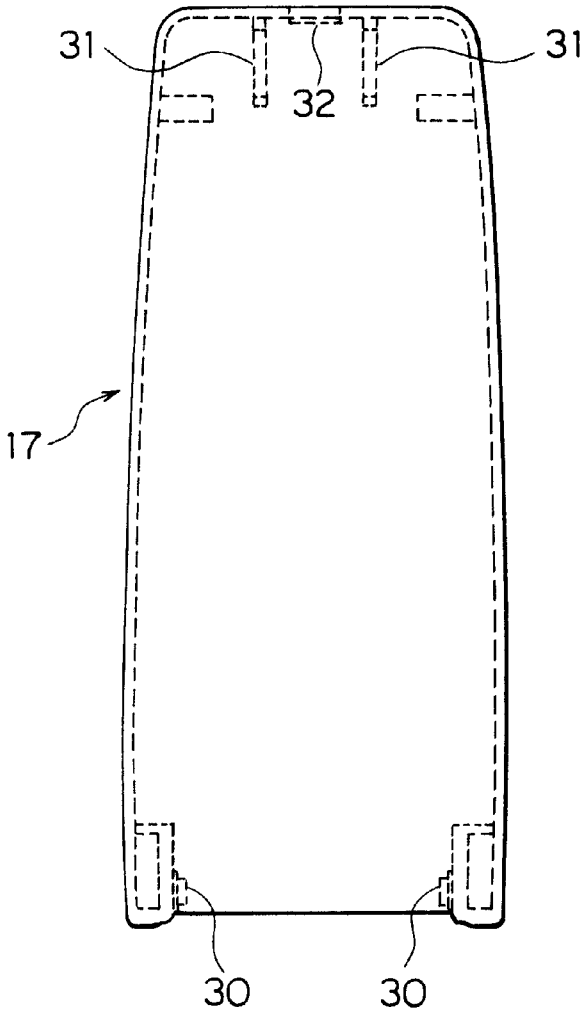
FIGS. 5A and 5B are a front view and a side view showing a top cover used in such embodiment, respectively.
Figure 5B:
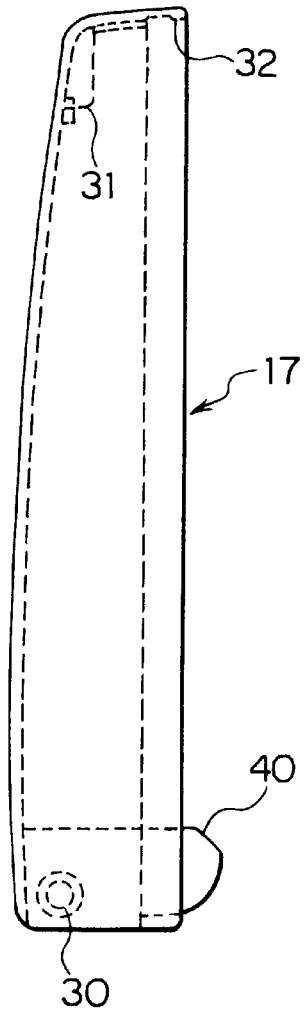

As shown in FIGS. 5A and 5B, shafts 30 to be fitted in the support holes opened in the top cover supports 21 of the case body 12 are provided on both insides of the bottom end portion of the top cover 17. Formed on the top end portion of the top cover 17 are protuberances 31 which engage with the top of the holding hook 29 of the holding member 15 and a protuberance 32 which engages with the recessed portion 23 of the case body 12.

In FIG. 1A, washers 34 are secured to the wall surface 11 with screws 33, and the case body 12 is slid downward with the washers 34 being inserted into mounting holes 35 of the case body 12 shown in FIG. 2A, thereby installing the case body 12 on the wall surface 11. An unillustrated double-sided adhesive tape is provided on the rear surface of the case body 12, so that the case body 12 can be mounted on the wall surface 11 by using the double-sided adhesive tape if the screws 33 cannot be used for the installation.

The shafts 25 of the pivoting member 13 are fitted in the support holes opened in the pivoting member supports 19 of the case body 12 to install the pivoting member 13 such that it is free to pivot toward or away from the wall surface 11, the operating lever 14 extending downward from the bottom of the case body 12. Further, the shafts 28 of the holding member 15 fit in the recessed portions of the holding member supports 20 of the case body 12, thereby allowing the holding member 15 to pivot up and down about the shafts 28. Disposed between the holding member 15 and the case body 12 is a flat spring 36 bent in a U shape, the flat spring 36 urging the holding member 15 to pivotally incline or more upwardly. In the state shown in FIGS. 1A and 1B, however, the engaging protuberances 27 engage with the holding member 15, so that the holding member 15 remains held rather than moving upwardly. The shafts 30 of the top cover 17 are fitted in the support holes opened in the top cover supports 21 of the case body 12 so as to enable the top cover 17 to open or close about the shafts 30.

Each of the chemiluminescent light sticks 16 comprises a tubular stick body with a head mounted on the top thereof for sealing the stick body, the head having a larger diameter than the stick body. The stick body and the head are made of a soft plastic material. The stick 16 contains a first reaction liquid inside and also includes a glass ampule filled with a second reaction liquid. When the chemiluminescent light stick 16 is bent to break the ampule inside, the first reaction liquid and the second reaction liquid mix with each other and react to cause the chemiluminescent light stick 16 to illuminate. For example, ester to which a fluorescent material is added may be used as the first reaction liquid, and hydrogen peroxide may be used as the second reaction liquid. Alternatively, the compositions of the first and second reaction liquids may be reversed.

The following describes how to set the chemiluminescent light sticks 16 in the emergency light having the structure explained above. First, it is assumed that the operating lever 14 has been pushed toward the wall surface 11 to release the holding member 15 from the engaging protuberances 27 of the pivoting member 13 and the top cover 17 has been hung down open. The chemiluminescent light sticks 16 are held by a hand of a user with the heads thereof facing upward, the bottom portions of the chemiluminescent light sticks 16 are inserted between the retaining portion 26 of the pivoting member 13 and the case body 12, and the holding member 15 is moved upwardly to insert the chemiluminescent light sticks 16 so that the heads of the sticks are positioned between the holding hook 29 of the holding member 15 and the chemiluminescent light stick retaining portions 22.

Then, the top cover 17 is pulled up to close it halfway, and within this state the chemiluminescent light sticks 16 are pushed in toward the wall surface 11. At this time, the rear surfaces of the chemiluminescent light sticks 16 come into contact with the protuberance 18 of the case body 12, and making use of the lever principle, the retaining portion 26 of the pivoting member 13 is pushed frontward such that the bottom end of the pivoting member 13 moves frontward while the top end thereof moves toward the wall surface 11. This causes the engaging protuberances 27 of the pivoting member 13 to push the holding member 15 so as to restrain the holding member 15 such that it does not move upwardly, thus holding the chemiluminescent light sticks 16 by the holding hook 29. Then, the top cover 17 is closed to engage the protuberance 32 of the top cover 17 with the recessed portion 23 of the case body 12 and to hold the holding member 15 by the protuberances 31 of the top cover 17. Thus, the two chemiluminescent light sticks 16 can be installed at the same time.

Figure 6:
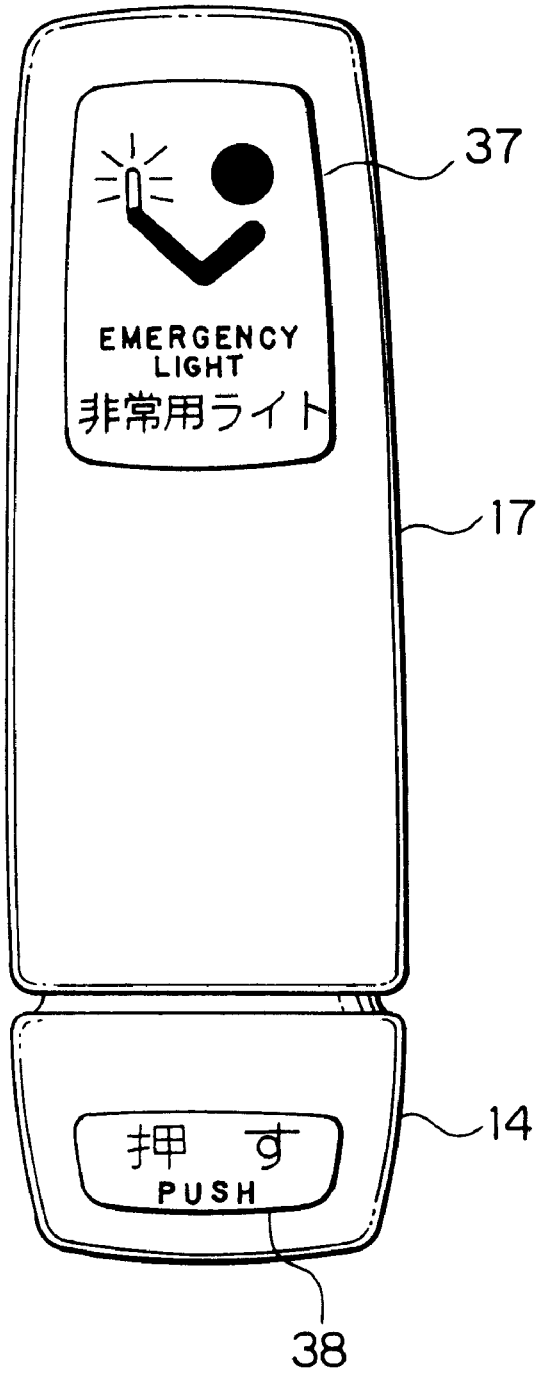
FIG. 6 is a front view showing the emergency light according to such embodiment.

As illustrated in FIG. 6, labels 37 and 38 which exhibit a good light accumulating property are attached to the top cover 17 and the operating lever 14, respectively, so as to enable a user to recognize the location of the emergency light even in the dark in case of a power failure or other emergency and also to permit easy recognition of the pushing operation of the operating lever 14.

Figure 7A:
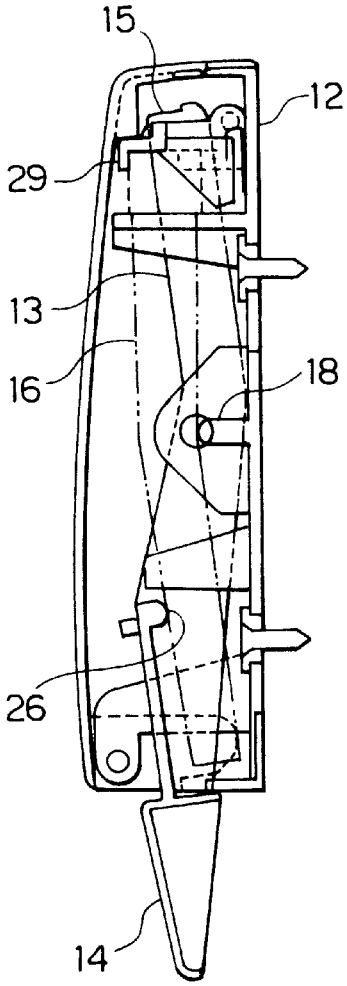
FIG. 7A is a side sectional view showing a state wherein a lever of the emergency light in accordance with such embodiment has been pushed.

The light emitting operation in case of an emergency will now be described. First, when the operating lever 14 on which the label 38 is adhered is pressed, the retaining portion 26 of the pivoting member 13 pushes the bottom portions of the chemiluminescent light sticks 16 toward the wall surface 11 as illustrated in FIG. 7A. Since the heads on the top ends of the chemiluminescent light sticks 16 are secured to the holding hook 29 of the holding member 15, the chemiluminescent light sticks 16 can be easily bent to the L shape according to the lever principle with the protuberance 18 of the case body 12 serving as the fulcrum and the retaining portion 26 serving as the point of action. At this time, the glass ampules inside break and the chemiluminescent light sticks 16 illuminate.

Figure 7B:
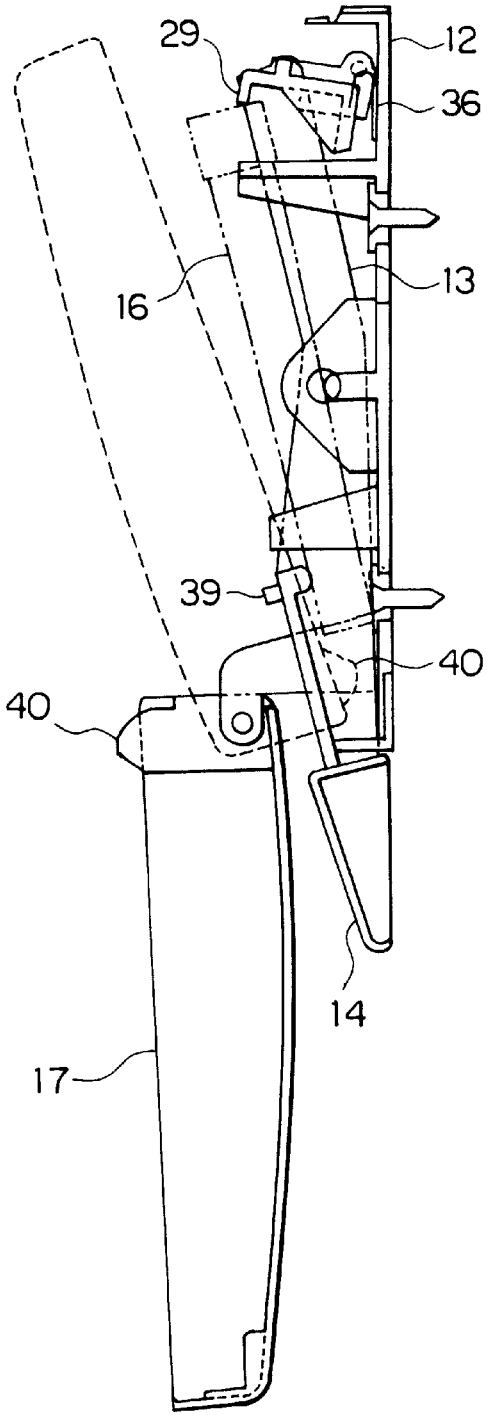
FIG. 7B is a side sectional view showing a state wherein the lever has been further pushed to open the top cover.

When the operating lever 14 is further pressed, the top end portions of the arms 24 of the pivoting member 13 protrude frontward to push the rear surface of the top cover 17, and the protuberance 32 of the top cover 17 comes off the recessed portion 23 of the case body 12, thus opening the top cover 17 as illustrated in FIG. 7B. At the same time, the holding member 15 which has been restrained by the engaging protuberances 27 of the pivoting member 13 is released and moved upwardly by the urging force of the flat spring 36 and the pushing force applied by the heads of the chemiluminescent light sticks 16. While the operating lever 14 is held depressed, the hooks 39 of the pivoting member 13 are held engaged with hooks 40 of the top cover 17 so as to hold the top cover 17 halfway open. As soon as the operating lever 14 is released, the hooks 39 and 40 are disengaged with each other to open the top cover 17 until it hangs downward perpendicularly.

It is possible, for example, to take out only one of the two chemiluminescent light sticks 16 emitting light to hold it in hand for evacuation or the like and to leave the other in the case body 12.

In the emergency light according to above embodiment, merely pressing the operating lever 14 enables the chemiluminescent light sticks 16 to illuminate and the top cover 17 to be opened, thus permitting extremely easy operation. Moreover, since the chemiluminescent light sticks 16 are bent by making use of the lever principle, the operation requires only a small force and the load applied to the wall surface 11 is accordingly low.

Figure 8:
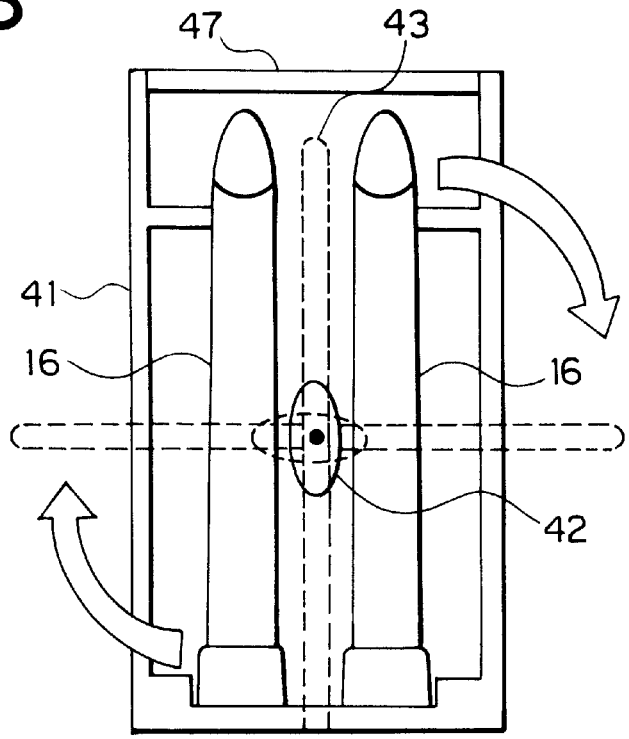
FIG. 8 is a front view showing the interior of an emergency light in accordance with another embodiment.

FIG. 8 shows an emergency light in accordance with another embodiment. A case body 41 is mounted on a wall surface or the like, and two chemiluminescent light sticks 16 are held upright side by side in the case body 41. A pressing jig 42 is provided between these chemiluminescent light sticks 16 and in the vicinity of the central portions of the chemiluminescent light sticks 16 such that it is free to rotate about an axis which is nearly perpendicular to the wall surface. Since the pressing jig 42 has an elliptical shape, it does not come in contact with the two chemiluminescent light sticks 16 when it is at the rotational position where the major axis thereof is directed vertically as indicated by the solid line, while the pressing jig 42 pushes the two chemiluminescent light sticks 16 laterally to bend them when jig 42 is at the rotational position where the major axis thereof is directed horizontally as indicated by the dashed line. Connected to the pressing jig 42 is a lengthy handle 43.

In case of an emergency, the handle 43 is turned to rotate the pressing jig 42 by, for example, 90 degrees, to bend the chemiluminescent light sticks 16 to cause them to illuminate.

Figure 9:
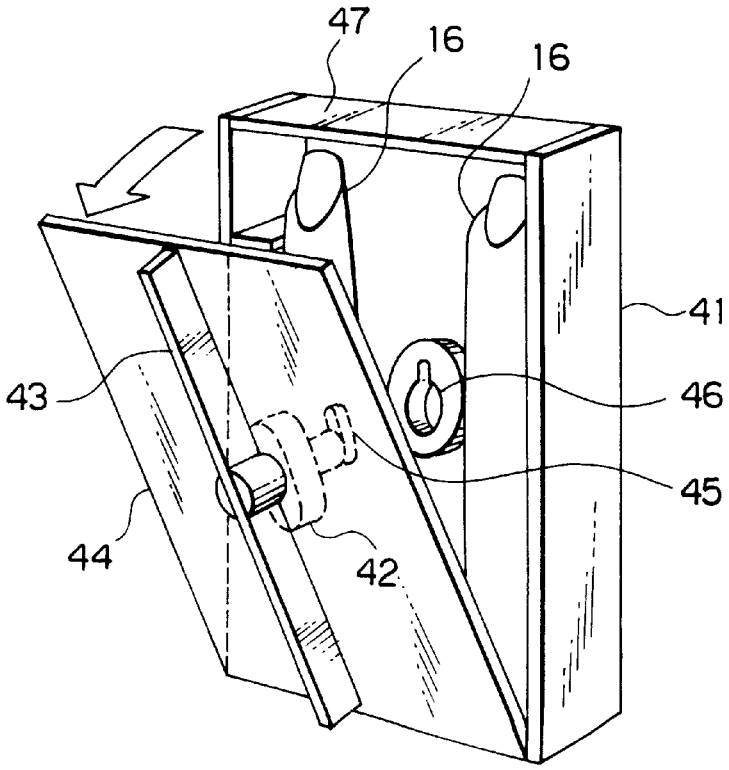
FIG. 9 is a perspective view illustrating the emergency light in accordance with another embodiment.
Figure 10:
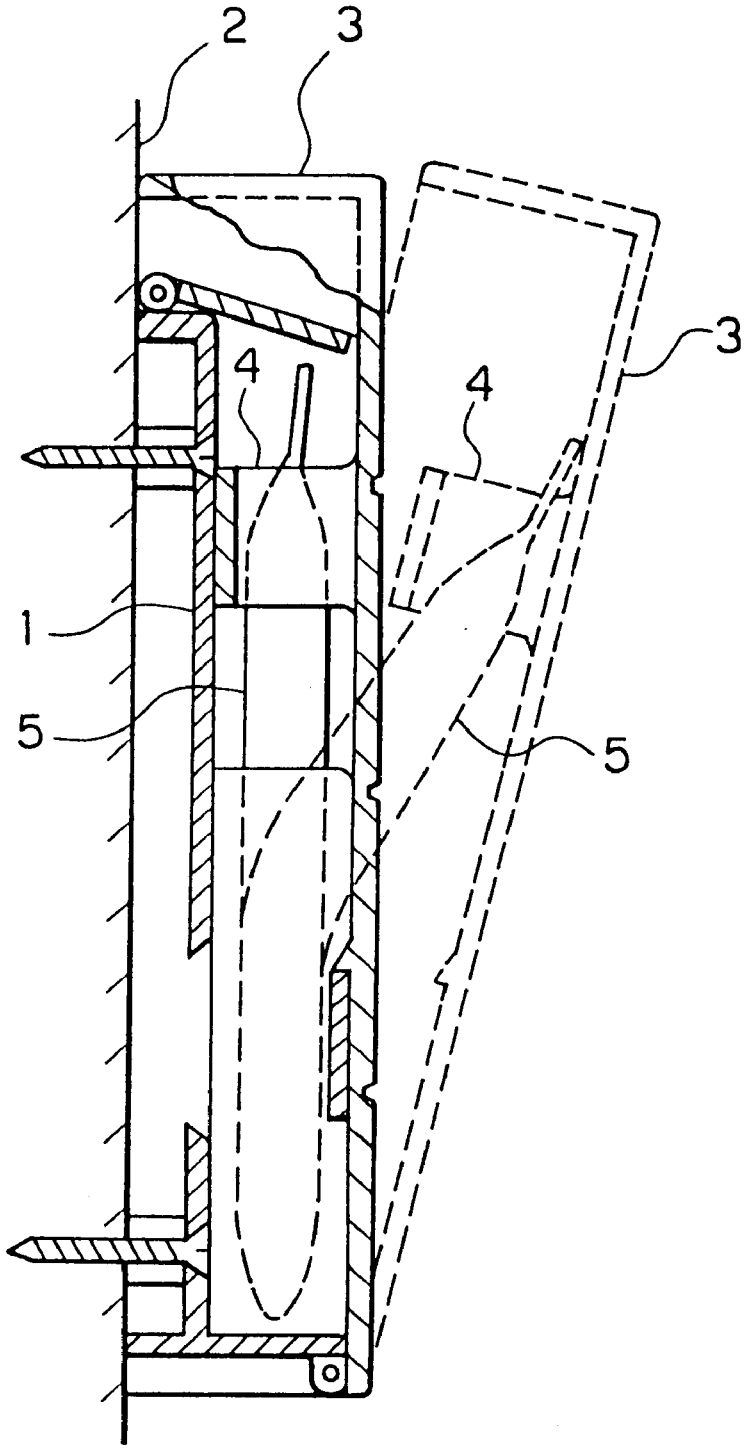
FIG. 10 (PRIOR ART)
FIG. 10 is a side sectional view showing a conventional emergency light.

For actual use, it is desirable to provide a top cover 44 to cover the front portion of the case body 41 such that it may be opened or closed, and to rotatably install the pressing jig 42 and the handle 43 on the rear side and the front side, respectively, of the top cover 44 to interconnect them as illustrated in FIG. 9. Further, a locking member 45 may be coupled to the pressing jig 42 and a key hole 46 to be fitted for the locking member 45 may be formed on the case body 41 so as to lock the open/close state of the top cover 44 by turning the handle 43. When the handle 43 is turned by 90 degrees in a state that the top cover 44 is closed, the chemiluminescent light sticks 16 are bent by the pressing jig 42 and they illuminate, and when the handle 43 is further turned by another 90 degrees, the locking member 45 is released from the key hole 46 and the top cover 44 opens, thereby making it possible to take out the chemiluminescent light sticks 16 which are emitting light.

In the emergency lights shown in FIG. 8 and FIG. 9 also, merely turning the handle 43 causes the chemiluminescent light sticks 16 to illuminate, permitting extremely easy operation. Moreover, since the chemiluminescent light sticks 16 are bent by making use of the lever principle, the operation requires a small force and the load applied to the wall surface 11 is accordingly low. To install the chemiluminescent light sticks 16 in the emergency light configured as explained above, the top cover 44 is closed to lock the locking member 45 in the key hole 46, or the pressing jig 42 is turned until it reaches a position where the major axis thereof is directed vertically so that it will not be in contact with the chemiluminescent light sticks 16, then top cover 47, for example, is opened to insert the chemiluminescent light sticks 16 into the case body 41.

Although the two chemiluminescent light sticks 16 are disposed side by side in both embodiments described above, the present invention is not limited thereto. One chemiluminescent light stick, or three or more chemiluminescent light sticks may be employed instead.

Thus, according to the present invention, it is possible to easily make chemiluminescent light sticks illuminate and to easily take them out even with a small force by utilization of the lever principle. This enables an emergency light to be realized which permits great ease of operation and applies less load to a wall surface or the like.

What is claimed is:

1. An emergency light comprising:

a case body which is to be mounted on a wall surface and which has a protuberance at the central portion thereof;

a pivoting member pivotably mounted on said case body to move toward or away from the wall surface, said pivoting member having a retaining portion formed at a level lower than the pivoting center of the pivoting member and having an operating lever formed by the bottom end portion thereof extending downward from said case body;

at least one chemiluminescent light stick which is disposed upright in said case body, the rear surface of the central portion of said stick being in contact with the protuberance of said case body, the front surface of the bottom of said stick being in contact with the retaining portion of said pivoting member; and a holding member for securing the top end portion of said chemiluminescent light stick to said case body, the bottom end portion of said chemiluminescent light stick contacted to the retaining portion of said pivoting member being pushed by pushing said operating lever toward the wall surface so that said chemiluminescent light stick is bent at the central portion thereof contacted to the protuberance of said case body to illuminating.

2. An emergency light according to claim 1 wherein said holding member is engaged with the top end of said pivoting member and mounted on said case body so as to vertically pivot by the pivoting motion of said pivoting member, said holding member pivoting upwardly to release the top end portion of said chemiluminescent light stick when said operating lever is further pushed toward the wall surface after said chemiluminescent light stick illuminates.

3. An emergency light according to claim 1 further comprising a top cover pivotably mounted around the bottom end portion of said case body to open or close for covering the front portion of said case body, said top cover being pushed to be opened by the top end portion of said pivoting member when said operating lever is pushed toward the wall surface.

4. An emergency light according to claim 1 wherein two chemiluminescent light sticks are disposed side by side in said case body.

5. An emergency light comprising:

a case body to be mounted to a wall surface;

at least one chemiluminescent light stick held in said case body;

a pressing jig which is rotatably provided in the vicinity of the central portion of said chemiluminescent light stick and which pushes said chemiluminescent light stick to bend it according to the rotational angle thereof; and a handle connected to said pressing jig;

said handle being turned to bend said chemiluminescent light stick through said pressing jig thereby to cause said chemiluminescent light stick to illuminate.

6. An emergency light according to claim 5 further comprising a top cover for covering the front portion of said case body such that it may be opened or closed, said pressing jig and said handle being retained on said top cover.

7. An emergency light according to claim 5 wherein two chemiluminescent light sticks are disposed side by side in said case body such that said pressing jig is located therebetween.

* * * * *